US007533691B2

(12) United States Patent
Marcoux et al.

(10) Patent No.: US 7,533,691 B2
(45) Date of Patent: May 19, 2009

(54) ADJUSTABLE DAMPER ASSEMBLY

(75) Inventors: Daniel Marcoux, St-Charles-de-Drummond (CA); Christian Légaré, Drummondville (CA); Martin Gagnon, St-Charles-de-Drummond (CA); Eric Charlebois, St-Nicéphore (CA)

(73) Assignee: Venmar Ventilation Inc., Drummondville (CA)

( * ) Notice: Subject to any disclaimer, the term of this patent is extended or adjusted under 35 U.S.C. 154(b) by 459 days.

(21) Appl. No.: 11/195,693

(22) Filed: Aug. 3, 2005

(65) Prior Publication Data

US 2006/0199525 A1 Sep. 7, 2006

(30) Foreign Application Priority Data

Jan. 11, 2005 (CA) ..... 2492258

(51) Int. Cl.
*F16K 15/18* (2006.01)
*F16K 51/00* (2006.01)
*F24F 13/10* (2006.01)

(52) U.S. Cl. ..... 137/523; 137/527; 251/285; 454/333

(58) Field of Classification Search ..... 137/522, 137/523, 527; 251/285; 454/333
See application file for complete search history.

(56) References Cited

U.S. PATENT DOCUMENTS

| | | | | |
|---|---|---|---|---|
| 2,086,942 | A * | 7/1937 | Mandeville | 137/522 |
| 2,285,829 | A * | 6/1942 | Maage, Jr. | 454/333 |
| 3,193,100 | A * | 7/1965 | Broughton | 137/522 |
| 3,651,829 | A * | 3/1972 | Frantz | 137/522 |
| 4,605,200 | A * | 8/1986 | Huppee | 137/523 |
| 4,628,954 | A | 12/1986 | Dayus | |
| 4,834,282 | A * | 5/1989 | Tenorio et al. | 137/523 |
| 5,806,830 | A | 9/1998 | Alvarez | |
| 6,029,698 | A * | 2/2000 | Murray et al. | 251/285 |
| 6,029,706 | A * | 2/2000 | Joo | 137/522 |
| 6,082,704 | A | 7/2000 | Grinbergs | |
| 6,959,909 | B2 * | 11/2005 | Bancroft et al. | 251/285 |

FOREIGN PATENT DOCUMENTS

GB 2 189 022 A 10/1987

* cited by examiner

*Primary Examiner*—John Rivell

(57) ABSTRACT

A damper assembly, comprising an adjustable locking means for releasable retention of an element pivotally in one of a plurality of predetermined lock positions for adjusting air flow through an opening.

18 Claims, 6 Drawing Sheets

ADJUSTABLE DAMPER ASSEMBLY

FIELD OF THE INVENTION

The present invention relates to a damper assembly for a duct ventilation. The present invention in particular relates to a damper assembly to balance the airflow in a ventilation duct. More particularly, the present invention relates to a damper assembly which may not only be used to balance the airflow in a ventilation duct but may also inhibit backflow.

BACKGROUND OF THE INVENTION

Balancing the airflow through a duct system is a necessary step in the effective exploitation of a ventilation system for the heating or cooling of an enclosure such as a home or other type of building.

It is known to exploit an adjustable damper device which has some method of ensuring that the damper does not move once it is adjusted; see, for example, U.S. Pat. No. 4,628,954, U.S. Pat. No. 5,806,830 and U.S. Pat. No. 6,082,704.

U.S. Pat. No. 5,806,830, for example describes an adjustable damper which exploits a conventional wing nut and lever arrangement, positioned on the exterior surface of the duct. The lever is attached directly to a damper valve inside the collar in the air flow. Adjustment is made by loosening the wing nut by hand, maneuvering the lever arrangement into the desired position, and finally tightening the wing nut by hand. The mechanism is, however, not self-locking and therefore is not easily positioned correctly; additionally it may be accidentally dislodged from the desired position over time.

U.S. Pat. No. 6,082,704 describes a damper mechanism whereby the damper valve in a damper collar body is held in position by spring tension which forces gear teeth on the damper rod in the damper collar body into mating engagement with gear teeth also in the inner collar body thus making the damper self-locking. The damper mechanism, however, requires the use of a separate tool to effect adjustments whereby the tool overcomes the biasing of the spring to effect separation of gear teeth and rotation of the damper.

It would be advantageous to have a damper assembly which could be incrementally adjustable as well as self-locking and which may also as desired also avoid the use of a separate tool in order to effect adjustments. It would also be advantageous if the assembly could provide an indication (e.g. on the outside of the assembly) of the position (e.g. maximum open position) of the damper member within the assembly. It would be advantageous if a damper member could rotate freely between a closed position and a pre-determined (i.e. adjustable) maximum damper open position; in other words to have a damper which may permit air flow in one direction while inhibiting air flow in an opposite direction and not exceed a maximum damper open position.

SUMMARY OF THE INVENTION

Thus the present invention relates to a damper assembly, comprising:

a support means defining an opening;

a damper component comprising a rotation element being pivotally mounted or connected to said support means, an adjustable locking means comprising a first portion mounted to the support means and a second portion mounted to the element pivotally connected to said support means, said adjustable locking means being configured for releasable retention of said rotation element pivotally connected to said support means in one of a plurality of predetermined lock positions, and wherein said first and second portions of said adjustable locking means are configured so that said rotation element pivotally connected to said support means can be rotated from one said predetermined lock position to another said predetermined lock position for adjusting air flow through said opening.

In accordance with the present invention, the first and second portions of the adjustable locking means may as desired or necessary be disposed outside of the opening (i.e. not in or exposed to the opening e.g. be disposed or mounted on the outside wall surface of the support means).

In accordance with the present invention, a damper assembly may include a finger gripping element connected to the rotation element pivotally connected to the support means, (e.g. to a shaft thereof), for manual rotation of the element pivotally connected to the support means (e.g. of the shaft thereof.)

In accordance with the present invention, a damper assembly may be an assembly wherein said element pivotally connected to said support means (e.g. a damper means or rotation limiter means as mentioned below) may comprise a shaft member pivotally mounted (i.e. or connected) to said support means for rotation of said element, wherein said second portion is mounted to said shaft member, wherein said first portion comprises a female component comprising a plurality of notches, and wherein said second portion comprises a male member and a lock biasing element, said male member being releasabley engageable in each of said notches for releasable locking engagement therewith and said lock biasing element being configured for biasing said male member into releasable locking engagement with a said notch, said first and second portions of said adjustable locking means being configured and disposed such that rotation of said shaft member is able to induce displacement of said male member from one said notch to another said notch.

In accordance with the present invention, a damper assembly may be an assembly wherein said lock biasing element comprises a resilient member mounted to said shaft member, wherein said male member is mounted to said resilient member and wherein said first and second portions of said adjustable locking means are configured so that said rotation limiter means can be rotated from one said predetermined lock position to another said predetermined lock position such that said male member is able to engage a predetermined notch in releasable snap-lock fashion.

In accordance with the present invention, the element pivotally connected to the support means may be a damper means itself. Alternatively, the element pivotally connected to said support means may be a rotation limiter means (i.e. a displacement limiter) configured and disposed for limiting rotation of a damper means between a first position and a predetermined maximum damper open position.

Thus, the present invention in accordance with an aspect thereof, provides a damper assembly, comprising:

a support means defining an opening;

a damper means pivotally mounted or connected to said support means;

an adjustable locking means comprising a first portion mounted to the support means and a second portion mounted to the damper means, said adjustable locking means being configured for releasable retention of said damper means in one of a plurality of predetermined lock positions, and wherein said first and second portions of said adjustable locking means are configured so that said damper means can be rotated from one said predetermined lock position to another said predetermined lock position for adjusting air flow through said opening.

In accordance with the present invention there is provided a damper assembly wherein said damper means comprises a shaft member pivotally mounted (or connected) to said support means for rotation of said damper means, wherein said second portion is mounted to said shaft member, wherein said first portion comprises a female component comprising a plurality of notches, and wherein said second portion comprises a male member and a lock biasing element, said male member being releasabley engageable in each of said notches for releasable locking engagement therewith and said lock biasing element being configured for biasing said male member into releasable locking engagement with a said notch, said first and second portions of said adjustable locking means being configured and disposed such that rotation of said shaft member is able to induce displacement of said male member from one said notch to another said notch.

In accordance with another aspect, the present invention, as mentioned above, relates to a damper assembly which may comprise a (damper) rotation limiter; in this case the associated damper means may be free swinging or it may be biased in a closed position.

Thus in accordance with another aspect the present invention provides a damper assembly, comprising:

a support means defining an opening;

damper means being pivotally mounted or connected to said support means, said damper means being able to rotate (e.g. swing) between a first position and a maximum damper open position under the influence of an air flow in a first direction through said opening a rotation limiter means (i.e. a displacement limiter) pivotally connected to said support means and configured and disposed for limiting rotation of said damper means between said first position and a predetermined maximum damper open position;

adjustable locking means comprising a first portion mounted to the support means and a second portion mounted to the rotation limiter means, said adjustable locking means being configured for releasable retention of said rotation limiter means in one of a plurality of predetermined lock positions corresponding to a respective predetermined maximum damper open position, and wherein said first and second portions of said adjustable locking means are configured so that said rotation limiter means can be rotated from one said predetermined lock position to another said predetermined lock position for adjusting air flow through said opening in said first direction.

In accordance with an additional aspect the present invention provides a (e.g. a balancing and backdraft inhibitor) damper assembly, comprising:

a support means defining an opening;

a damper means pivotally connected to said support means, said damper means being able to rotate (e.g. swing) between a blocking position and a maximum damper open position;

a biasing means (e.g. spring biasing means), said biasing means biasing said damper means in said blocking position a. such that air flow through said opening in a first direction is able to displace said damper means from said blocked position to an open position whereby air flow may pass through said opening in said first direction and b. such that air flow through said opening in a second opposite direction is blocked;

rotation limiter means (i.e. displacement limiter) pivotally connected to said support means and configured for limiting rotation of said damper means between said first position and one of a plurality of predetermined maximum damper open positions; and adjustable locking means comprising a first portion mounted to the support means and a second portion mounted to the rotation limiter means, said adjustable locking means being configured for releasable retention of said rotation limiter means in one of a plurality of predetermined lock positions corresponding to a respective predetermined maximum damper open position; and wherein said first and second portions of said adjustable locking means are configured so that said rotation limiter means can be rotated from one said predetermined lock position to another said predetermined lock position for adjusting air flow through said opening in said first direction.

In accordance with the present invention, a (e.g. balancing and backdraft inhibitor) damper assembly may include a finger gripping element connected to the rotation limiter means, (e.g. a shaft thereof) for manual rotation of the rotation limiter means (e.g. of the shaft thereof).

In accordance with the present invention, a (e.g. balancing and backdraft inhibitor) damper assembly may be an assembly wherein said rotation limiter means comprises a shaft member pivotally mounted (or connected) to said support means for rotation of said rotation limiter means, wherein said second portion is mounted to said shaft member, wherein said first portion comprises a female component comprising a plurality of notches, and wherein said second portion comprises a male member and a lock biasing element, said male member being releasabley engageable in each of said notches for releasable locking engagement therewith and said lock biasing element being configured for biasing said male member into releasable locking engagement with a said notch, said first and second portions of said adjustable locking means being configured and disposed such that rotation of said shaft member is able to induce displacement of said male member from one said notch to another said notch.

In accordance with the present invention, a (e.g. balancing and backdraft inhibitor) damper may be an assembly wherein said lock biasing element comprises a resilient member mounted to said shaft member, wherein said male member is mounted to said resilient member and wherein said first and second portions of said adjustable locking means are configured so that said rotation limiter means can be rotated from one said predetermined lock position to another said predetermined lock position such that said male member is able to engage a predetermined notch in releasable snap-lock fashion.

The biasing means and lock biasing element mentioned herein may take any suitable form keeping in mind the purpose thereo; the may be based on springs (e.g. a helical spring, a coil spring, etc.) resilient members which provide such biasing (e.g. leaf spring, etc.)

As may be appreciated from the above, a damper assembly in accordance with the present invention may be incrementally adjustable as well as self-locking and which may also as desired also avoid the use of a separate tool in order to effect adjustments. A damper assembly in accordance with the present invention may also provide an indication (e.g. on the outside of the assembly) of the position (e.g. maximum open position) of the damper member within the assembly. A damper assembly in accordance with the present invention may further comprise a damper member or means which may rotate freely between a closed position and a pre-determined (i.e. adjustable) maximum damper open position; in other words have a damper member or means which may permit air flow in one direction while inhibiting air flow in an opposite direction and not exceed a maximum damper open position.

BRIEF DESCRIPTION OF THE DRAWINGS

The present invention will be described below in detail with the aid of the accompanying drawings, in which example embodiments of the invention are illustrated:

FIGS. 8*a*, 8*b*, 8*c* and 8*d* illustrates in schematic fashion the disposition of the rotation limiter means and the damper means wherein the damper means abuts against the rotation limiter means at different maximum damper open positions;

DETAILED DESCRIPTION OF EXAMPLE EMBODIMENTS

Figure 8:
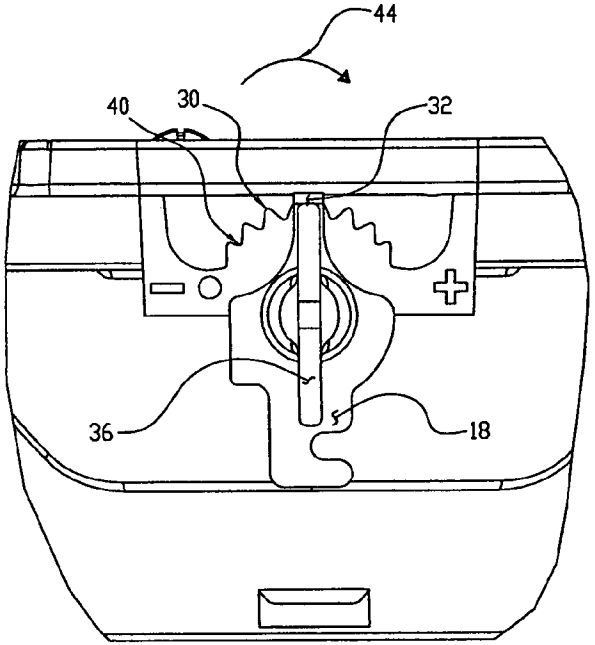
FIGS. 6, 7 and 8 are partial enlarged schematic illustrations of the components of the adjustable locking means in the process of passing from 1 notch to another notch (i.e. from one releasable locking position to another)
Figure 7:
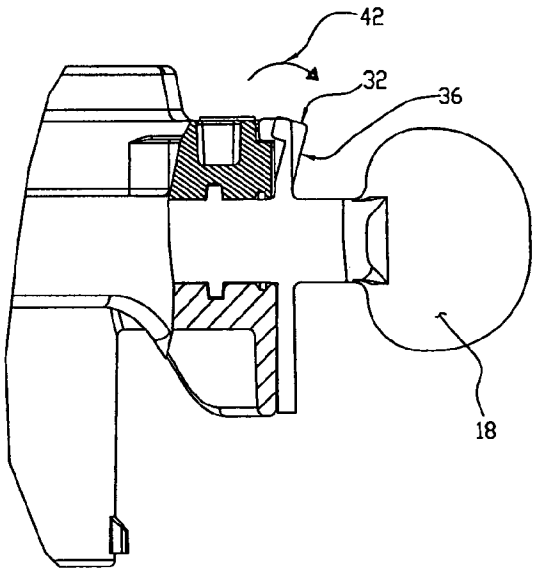
Figure 6:
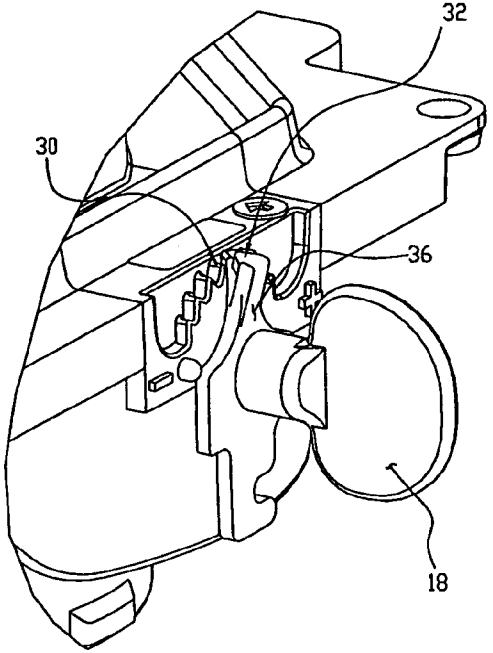

FIGS. 1 to 8 illustrate a damper assembly 1 in accordance with the present invention wherein the same reference numerals refer to the same elements. The assembly 1 comprises a support means includes a collar body comprising an inner collar member 6 and an outer collar member 8. The collar members 6 and 8 are spaced apart and are configured to accommodate therebetween a like shaped insulated ventilation or heating pipe. As may be seen the support body defines an opening. A rotation limiter means generally designated by the reference numeral 10 is also provided by the damper assembly. The rotation limiter means 10 has the form of a rod like member having a U-shaped like form. The rotation limiter means 10 is pivotally connected or mounted in the opening defined by the support means. One end of the rotation limiter means 10 is rotatably engaged in a socket like element 12 projecting from the interior surface of the inner collar member 6. The other end of the rotation limiter means 10 comprises a shaft member 14 which is rotatabley disposed in a longitudinally extending channel and extends through to the exterior side of the outer collar member 8 terminating in a finger tab or gripping member 18. The shaft 14 has circular retention discs 20 which rotatabley engage correspondingly shaped circular channels 22; a half portion of the channels 22 being shown in FIG. 1; the other half portions thereof (not shown) are defined by the hidden underside of the retainer member 26. The retainer member 26 is maintained in place by a suitable adhesive or glue or by mechanical means such as screws, press fit, etc. Thus the retention dics 20 retain the shaft member 14 in place when the shaft member 14 is urged to rotate by a user grasping the finger tab member 18 and turning it (as illustrated in FIGS. 6, 7 and 8)

The damper assembly 1 has adjustable locking means which has a female component 30 and a male component 32. The male component 32 is connected or mounted to the shaft member 14 on the exterior side of the outer collar member 8 by a resilient connector member 36. The resilient connector member 36 may be of any suitable material keeping in mind its biasing function (e.g. of a suitable plastics material). The male component 32 may for example have a wedge like shape. The female component 30 is also disposed along the exterior wall of the outer collar member 8. The female component 30 comprises a plurality of notch elements one of which is designated by the reference numeral 40, (see for example FIG. 8). The resilient connector member 36 (i.e. a lock biasing element) is configured and disposed so as to be able to releasabley bias the male component 30 in a notch 40. Each of the notches 40 is shaped so as to be able to engage or mate with the wedge like male component 30 in releasable snap lock type fashion such that the locking means is releasabley self-locking. In other words, (please see FIGS. 6, 7 and 8, arrows 42 and 44) as the shaft member 14 is urged to rotate by suitable force being applied to the finger tab member 18 the male component 32 element is urged to ride up the perimeter of a notch 40 in the direction of rotation while also being urged against the biasing force of the resilient member which is bent back until the male component 32 naps back into engagement with a predetermined or desired notch 40.

As may be appreciated each notch position defines a releasable lock position for the rotation limiter means which in turn defines a predetermined maximum damper open position. Advantageously, indicia (not shown) may be associated with each notch which may be indicative of the maximum open position of the damper or the maximum degree of opening able to be achieved by the damper member for the various lock positions defined by the notches.

Figure 1:
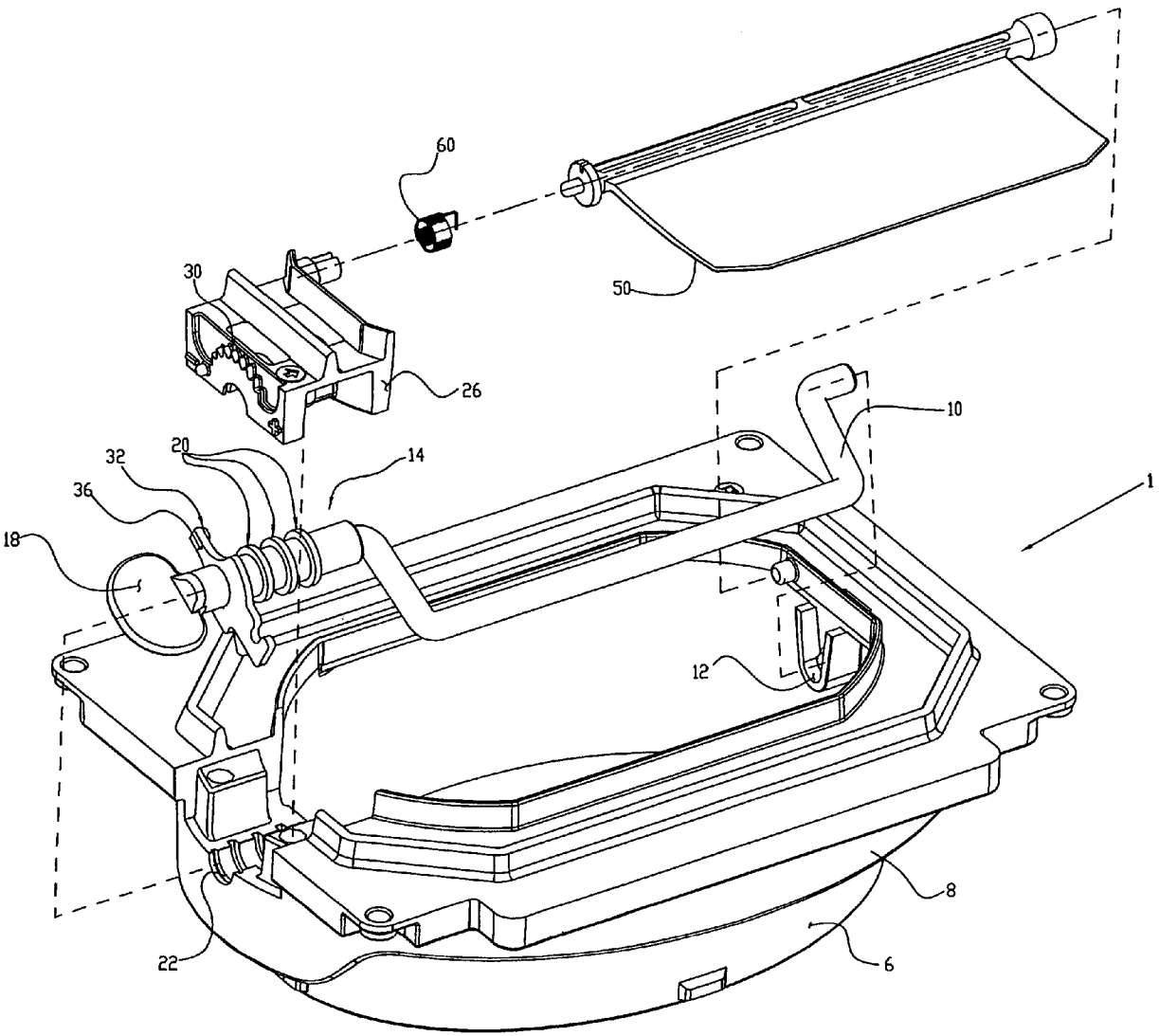
FIG. 1 is an exploded perspective view of an example embodiment of a damper assembly in accordance with the present invention provided with a biased damper means and a rotation limiter means for restriction of the rotation of the damper means.
Figures 2, 3, 3A, 3B, 4, 5:
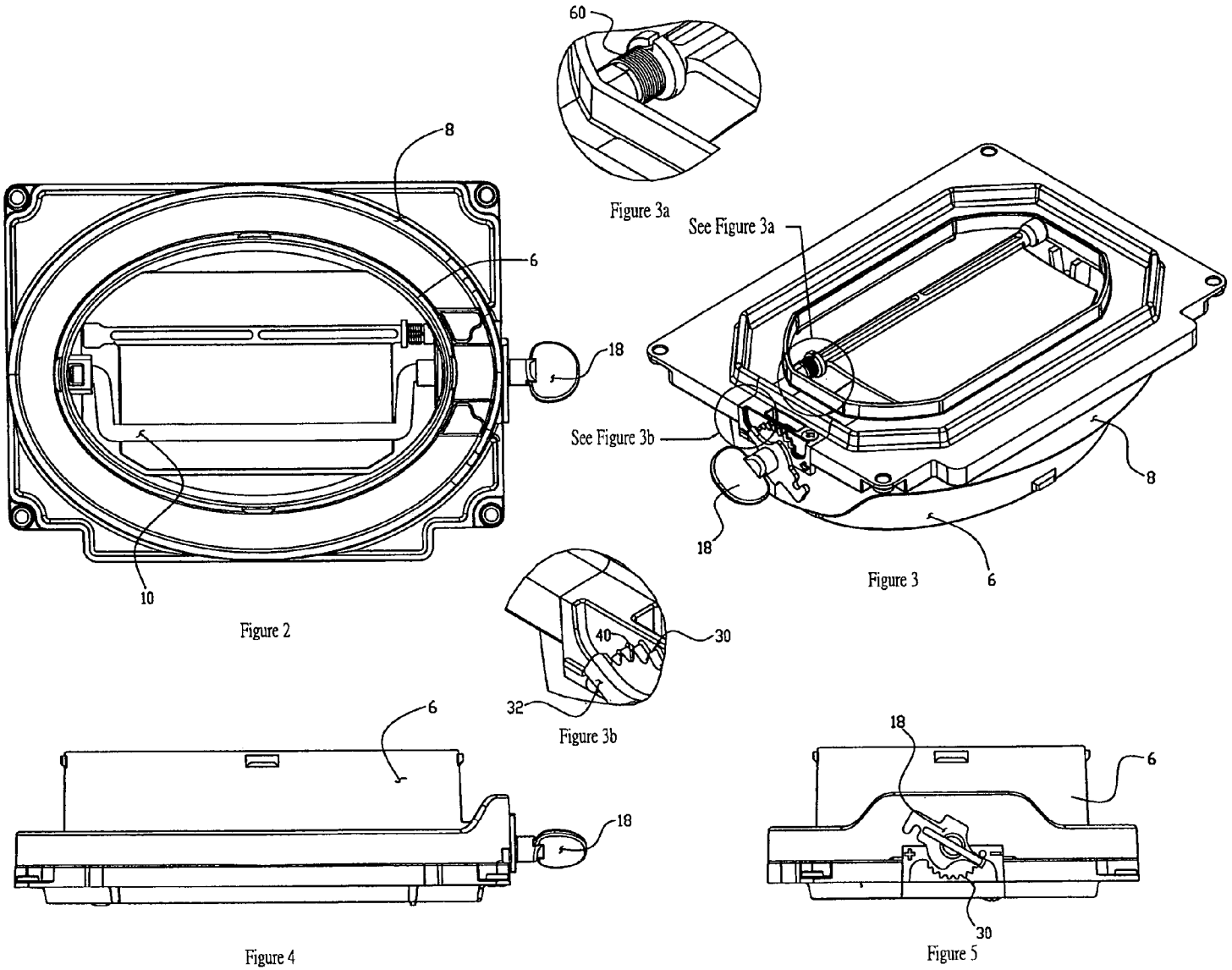
FIG. 2 is a view illustrating the damper assembly of FIG. 1 wherein the rotation limiter means is shown in front of (or on top of) the damper means.
FIG. 3 is a view opposite to that of FIG. 2 illustrating the damper assembly of FIG. 1 wherein the rotation limiter means is shown behind or in back of the damper means.
FIG. 3*a* is a partial expanded cut out portion of the damper assembly as shown in FIG. 3 illustrating the helical spring urging the damper means in blocking position.
FIG. 3*b* is a partial expanded cut out portion of the damper assembly as shown in FIG. 3 illustrating the male and female component of the adjustable locking means.
FIG. 4 is a side view of the damper assembly as shown in FIG. 2.
FIG. 5 is a side view of the damper assembly as shown in FIG. 3.
Figure 8D:
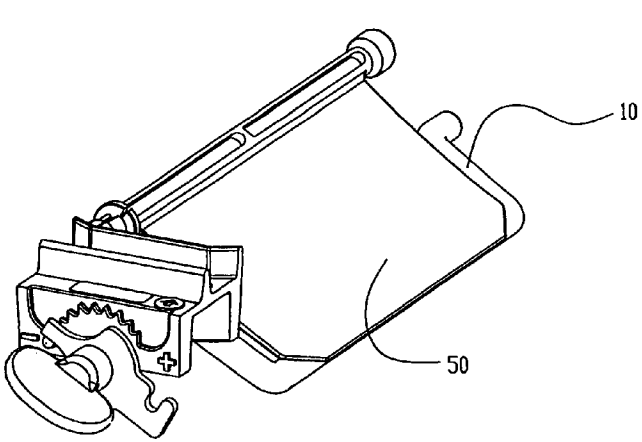
Figure 8D:
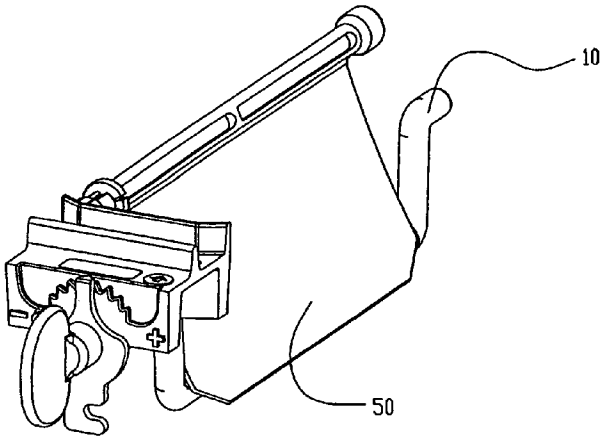
Figure 8D:
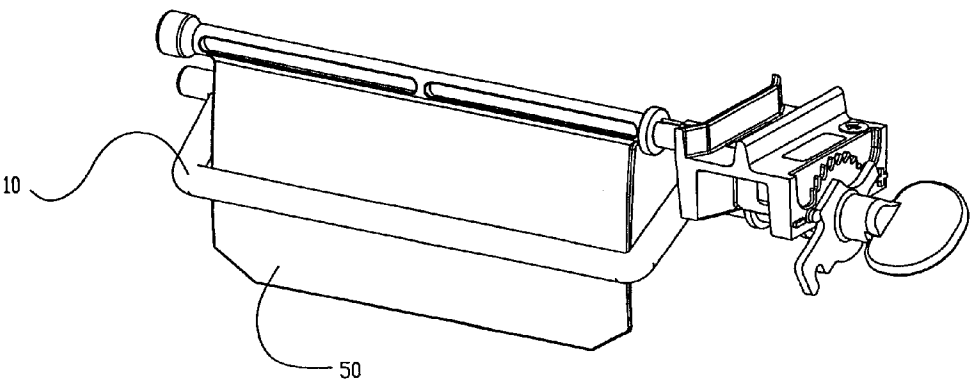
Figure 8D:
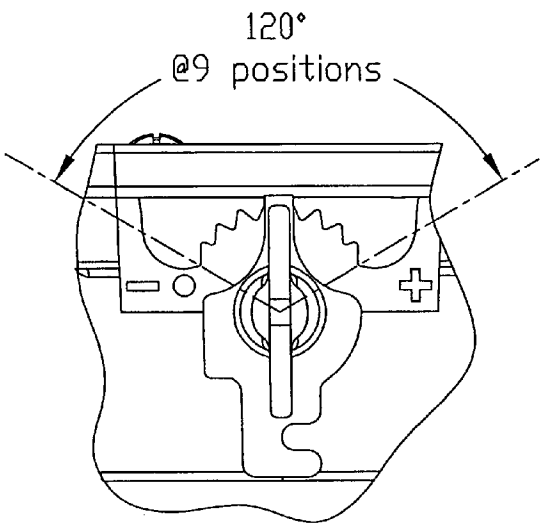

The damper assembly also is provided with a damper member 50 which is also pivotally connected or mounted in the opening defined by the support means. The damper member 50 is mounted at each side by a pin-socket type pivot connection which allows the damper member to swing between a first (i.e. blocking) position as shown in FIGS. 2 and 3 and a maximum damper open position defined by the rotation limiter means 10 (see FIGS. 8*a*, 8*b* and 8*c*); in the maximum damper open position the damper means 10 abuts the rotation limiter means. FIG. 8*d* shows in detail the 9 incremental lock positions of the rotation limiter means 10 over 120 degrees of arc; the locking means could of course use a different number of increments over the 120 degree arc and/or a larger or smaller arc as desired or necessary.

In the damper blocking position the damper may rest up against or abut a stopper element (not shown) defined by the support means.

The damper assembly also comprises a damper biasing element in the form of a helical spring 60 which is fixed to the support means at one end thereof and to the damper member at the other end thereof. The spring 60 and damper means 50 are mounted so that the spring 60 biases the damper means 50 in the first position mentioned above.

Thus as air flows through the opening defined by the support means in a first direction subjecting the damper means to a counter force relative to the biasing force of the spring 60, the damper means 50 is able to swing open to a maximum damper open position defined by the rotation limiter means; on the other hand, a flow of air in the opposite (i.e. second) direction will impinge against the damper means in the blocking position; i.e. the damper acts as a type of checkvalve allowing flow of air in one direction but blocking the flow of air in the opposite direction.

Figure 9:
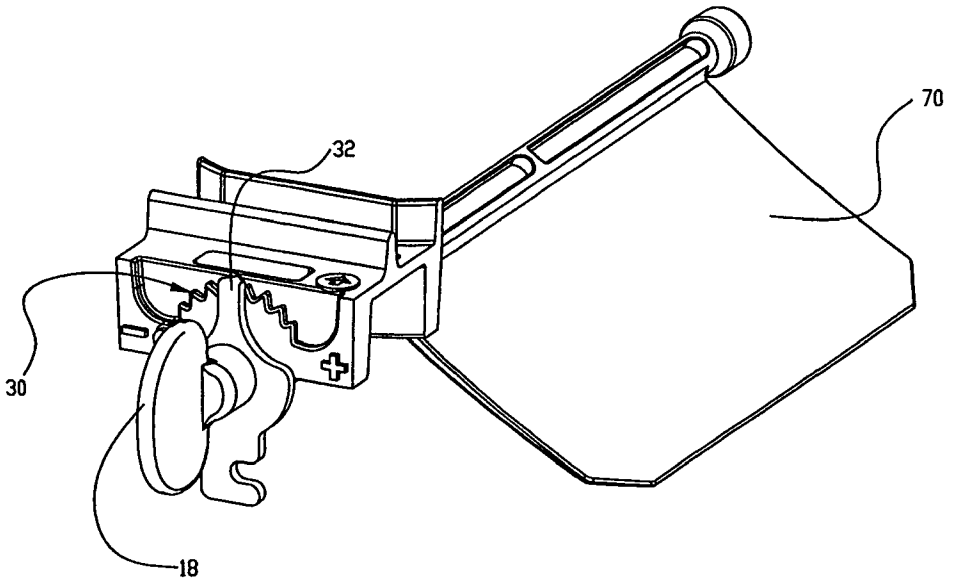
FIGS. 9 and 9*a* are perspective schematic views of a damper means itself being provided with an adjustable locking means as shown in the previous figures.
Figure 9A:
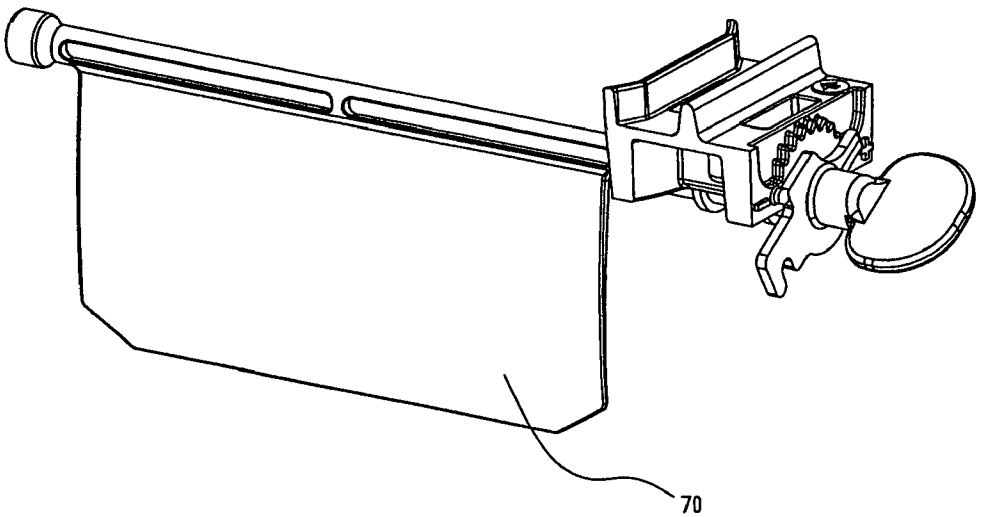

Although the adjustable locking means has been described in relation to a rotation limiter means it could of course be used to incrementally adjust the position of a damper member 70 directly (see FIGS. 9 and 9*a*).

Figure 10:
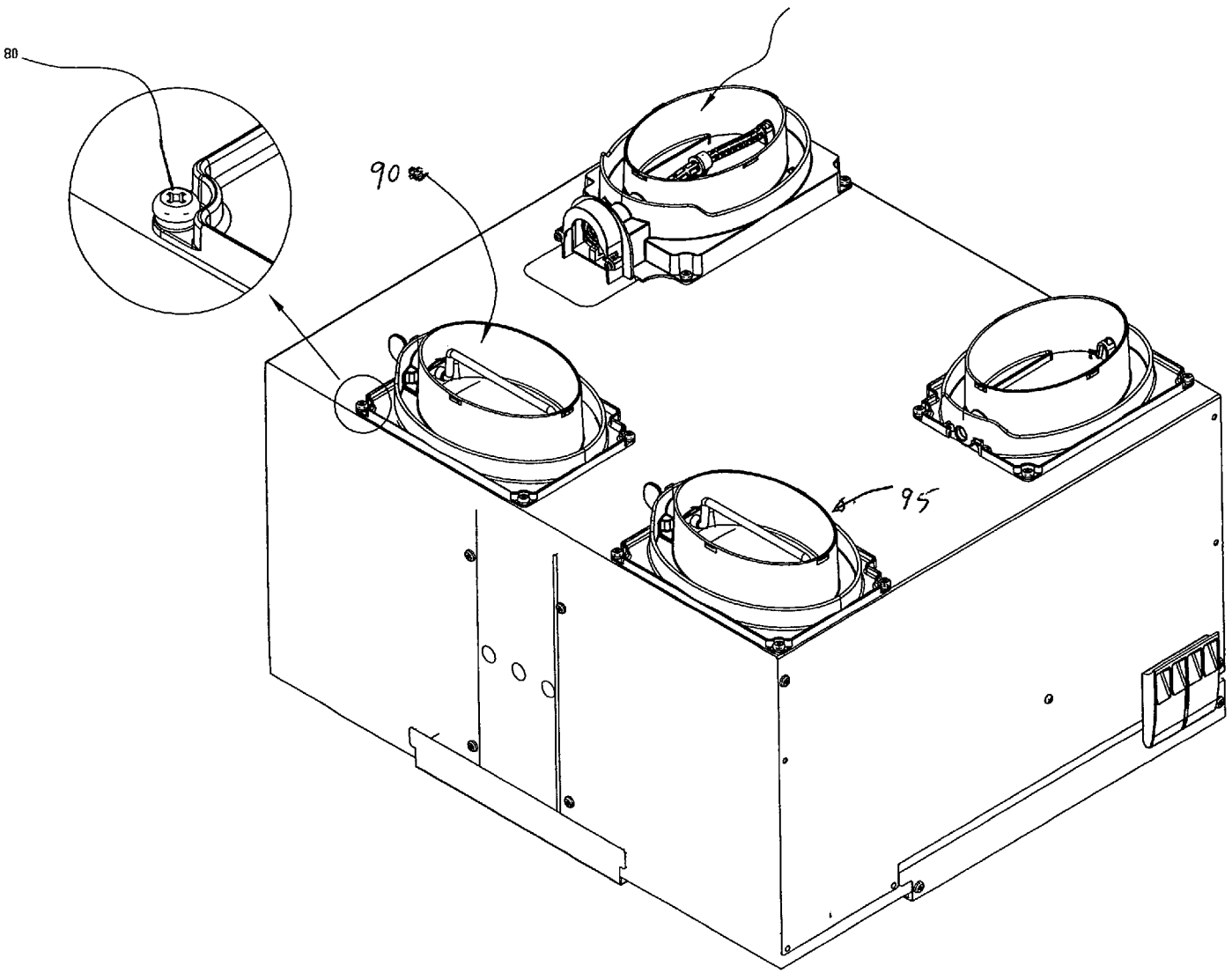
FIG. 10 is a perspective schematic view showing a pair of damper assemblies in accordance with the present invention attached to the housing of a ventilation device so as to define respective parts of air paths defined by the ventilation device.

Turning to FIG. 10 this figure is a perspective schematic view showing a pair of damper assemblies in accordance with the present invention attached to the housing of a ventilation device. The damper assemblies may be attached to the ventilation housing in any suitable or desired manner for example by the use of screws 80. The damper assemblies each define a respective part of a respective air path defined by the internal components of the ventilation device (internal air paths not shown). One damper assembly 90 defines a stale air outlet while the other damper assembly 95 defines a fresh air outlet.

What is claimed is:

1. A damper assembly, comprising:

a support means defining an opening;

a damper component comprising a rotation element pivotally connected to said support means;

an adjustable locking means comprising a first portion mounted to the support means and a second portion mounted to the rotation element pivotally connected to said support means, said adjustable locking means being configured for releasable retention of said rotation element pivotally connected to said support means in one of a plurality of predetermined lock positions;

wherein said first and second portions of said adjustable locking means are configured so that said rotation element pivotally connected to said support means can be rotated from one said predetermined lock position to another said predetermined lock position for adjusting air flow through said opening wherein said rotation element pivotally connected to said support means comprises a shaft member pivotally mounted to said support means for rotation of said rotation element, wherein said second portion is mounted to said shaft member, wherein said first portion comprises a female component comprising a plurality of notches, and wherein said second portion comprises a male member and a lock biasing element, said male member being releasably engageable in each of said notches for releasable locking engagement therewith and said lock biasing element being configured for biasing said male member into releasable locking engagement with a said notch, said first and second portions of said adjustable locking means being configured and disposed such that rotation of said shaft member is able to induce displacement of said male member from one said notch to another said notch.

2. A damper assembly as defined in claim 1 wherein said first and second portions of said adjustable locking means are disposed outside of said opening.

3. A damper assembly as defined in claim 1 including a finger gripping element connected to said shaft member, for manual rotation of said shaft member.

4. A damper assembly as defined in claim 1 wherein said rotation element pivotally connected to said support means is a rotation limiter means configured and disposed for limiting rotation of a damper means between a first position and a predetermined maximum damper open position.

5. A damper assembly as defined in claim 3 wherein said first and second portions of said adjustable locking means are disposed outside of said opening.

6. A damper assembly, comprising:

a support means defining an opening;

a damper means pivotally mounted to said support means;

an adjustable locking means comprising a first portion mounted to the support means and a second portion mounted to the damper means, said adjustable locking means being configured for releasable retention of said damper means in one of a plurality of predetermined lock positions;

wherein said first and second portions of said adjustable locking means are configured so that said damper means can be rotated from one said predetermined lock position to another said predetermined lock position for adjusting air flow through said opening wherein said damper means comprises a shaft member pivotally mounted to said support means for rotation of said damper means, wherein said second portion is mounted to said shaft member, wherein said first portion comprises a female component comprising a plurality of notches, and wherein said second portion comprises a male member and a lock biasing element, said male member being releasably enciageable in each of said notches for releasable locking engagement therewith and said lock biasing element being configured for biasing said male member into releasable locking engagement with a said notch, said first and second portions of said adiustable locking means being configured and disposed such that rotation of said shaft member is able to induce displacement of said male member from one said notch to another said notch.

7. A damper assembly as defined in claim 6 wherein said first and second portions of said adjustable locking means are disposed outside of said opening.

8. A damper assembly as defined in claim 6 including a finger gripping element connected to said shaft member, for manual rotation of the said shaft member.

9. A damper assembly as defined in claim 8 wherein said first and second portions of said adjustable locking means are disposed outside of said opening.

10. A damper assembly, comprising:

a support means defining an opening;

damper means pivotally mounted to said support means, said damper means being able to rotate between a first position and a maximum damper open position under the influence of an air flow in a first direction through said opening;

a rotation limiter means pivotally connected to said support means and configured and disposed for limiting rotation of said damper means between said first position and a predetermined maximum damper open position;

adjustable locking means comprising a first portion mounted to the support means and a second portion mounted to the rotation limiter means, said adjustable locking means being configured for releasable retention of said rotation limiter means in one of a plurality of predetermined lock positions corresponding to a respective predetermined maximum damper open position;

wherein said first and second portions of said adjustable locking means are configured so that said rotation limiter means can be rotated from one said predetermined lock position to another said predetermined lock position for adjusting air flow through said opening in said first direction wherein said rotation limiter means comprises a shaft member pivotally mounted to said support means for rotation of said rotation limiter means, wherein said second Dortion is mounted to said shaft member, wherein said first portion comprises a female component comprising a plurality of notches, and wherein said second portion comprises a male member and a lock biasinci element, said male member being releasably engageable in each of said notches for releasable locking engagement therewith and said lock biasing element being configured for biasing said male member into releasable locking engagement with a said notch, said first and second Dortions of said adiustable locking means being configured and disposed such that rotation of said shaft member is able to induce disDlacement of said male member from one said notch to another said notch.

11. A damper assembly as defined in claim 10 wherein said first and second portions of said adjustable locking means are disposed outside of said opening.

12. A damper assembly as defined in claim 10 including a finger gripping element connected to said shaft member, for manual rotation of said shaft member.

13. A damper assembly as defined in claim 12 wherein said first and second portions of said adjustable locking means are disposed outside of said opening.

14. A damper assembly, comprising:

a support means defining an opening;

a damper means pivotally mounted to said support means, said damper means being able to rotate between a blocking position and a maximum damper open position;

a biasing means, said biasing means biasing said damper means in said blocking position;

such that air flow through said opening in a first direction is able to displace said damper means from said blocked position to an open position whereby air flow may pass through said opening in said first direction and such that air flow through said opening in a second opposite direction is blocked;

rotation limiter means pivotally connected to said support means and configured and disposed for limiting rotation of said damper means between said first position and one of a plurality of predetermined maximum damper open positions;

adjustable locking means comprising a first portion mounted to the support means and a second portion mounted to the rotation limiter means, said adjustable locking means being configured for releasable retention of said rotation limiter means in one of a plurality of predetermined lock positions corresponding to a respective predetermined maximum damper open position;

wherein said first and second portions of said adjustable locking means are configured so that said rotation limiter means can be rotated from one said predetermined lock position to another said predetermined lock position for adjusting air flow through said opening in said first direction wherein said rotation limiter means comprises a shaft member pivotally mounted to said support means for rotation of said rotation limiter means, wherein said second portion is mounted to said shaft member, wherein said first portion comprises a female component comprising a plurality of notches, and wherein said second portion comprises a male member and a lock biasing element, said male member being releasably engageable in each of said notches for releasable locking engagement therewith and said lock biasing element being configured for biasing said male member into releasable locking engagement with a said notch, said first and second portions of said adiustable locking means being configured and disposed such that rotation of said shaft member is able to induce displacement of said male member from one said notch to another said notch.

15. A damper assembly as defined in claim 14 wherein said first and second portions of said adjustable locking means are disposed outside of said opening.

16. A damper assembly as defined in claim 14 including a finger gripping element connected to said shaft member, for manual rotation of said shaft member.

17. A damper assembly as defined in claim 16 wherein said first and second portions of said adjustable locking means are disposed outside of said opening.

18. A damper assembly as defined in claim 15 wherein said lock biasing element comprises a resilient member mounted to said shaft member, wherein said male member is mounted to said resilient member and wherein said first and second portions of said adjustable locking means are configured so that said rotation limiter means can be rotated from one said predetermined lock position to another said predetermined lock position such that said male member is able to engage a predetermined notch in releasable snap-lock fashion.

* * * * *